US010679784B1

(12) United States Patent
Isurin et al.

(10) Patent No.: US 10,679,784 B1
(45) Date of Patent: Jun. 9, 2020

(54) METHOD OF FORMING A TRANSFORMER WINDING

(71) Applicant: VANNER, INC., Hilliard, OH (US)

(72) Inventors: Alexander Isurin, Dublin, OH (US); Alexander Cook, Dublin, OH (US)

(73) Assignee: VANNER, INC., Hilliard, OH (US)

( * ) Notice: Subject to any disclaimer, the term of this patent is extended or adjusted under 35 U.S.C. 154(b) by 64 days.

(21) Appl. No.: 15/663,874

(22) Filed: Jul. 31, 2017

Related U.S. Application Data

(60) Provisional application No. 62/368,250, filed on Jul. 29, 2016.

(51) Int. Cl.

| | |
|---|---|
| ***H01F 7/06*** | (2006.01) |
| ***H01F 27/08*** | (2006.01) |
| ***H01F 27/28*** | (2006.01) |
| ***H01F 41/06*** | (2016.01) |
| ***H01F 41/04*** | (2006.01) |

(52) U.S. Cl.
CPC ..... *H01F 27/08* (2013.01); *H01F 27/2804* (2013.01); *H01F 27/2876* (2013.01); *H01F 41/041* (2013.01); *H01F 41/06* (2013.01)

(58) Field of Classification Search
CPC .. H01F 27/08; H01F 27/2804; H01F 27/2876; H01F 41/0418; H01F 41/06
See application file for complete search history.

(56) References Cited

U.S. PATENT DOCUMENTS

| | | | | |
|---|---|---|---|---|
| 3,691,498 | A * | 9/1972 | Zwelling | H01F 5/06 336/205 |
| 4,847,583 | A * | 7/1989 | Bernard | H01F 30/16 336/84 C |
| 5,206,621 | A * | 4/1993 | Yerman | H01F 27/2804 336/180 |
| 6,114,932 | A * | 9/2000 | Wester | H01F 17/0006 336/192 |
| 7,123,123 | B2 | 10/2006 | Isurin et al. | |
| 2007/0277994 | A1* | 12/2007 | Schafer | H01F 27/322 174/105 R |
| 2008/0157914 | A1* | 7/2008 | Pokharna | H01F 27/306 336/220 |
| 2013/0088315 | A1* | 4/2013 | Clouser | H01F 5/04 336/182 |

* cited by examiner

*Primary Examiner* — Paul D Kim
(74) *Attorney, Agent, or Firm* — Ronald J. Koch; The Eley Law Firm

(57) ABSTRACT

A high current transformer winding made from a flat conductor having opposing ends that are shaped (e.g. a lateral protrusion), such that when a middle portion of the conductor is wound around a transformer core, one or both opposing ends protrude to allow operative connection to a power source.

14 Claims, 10 Drawing Sheets

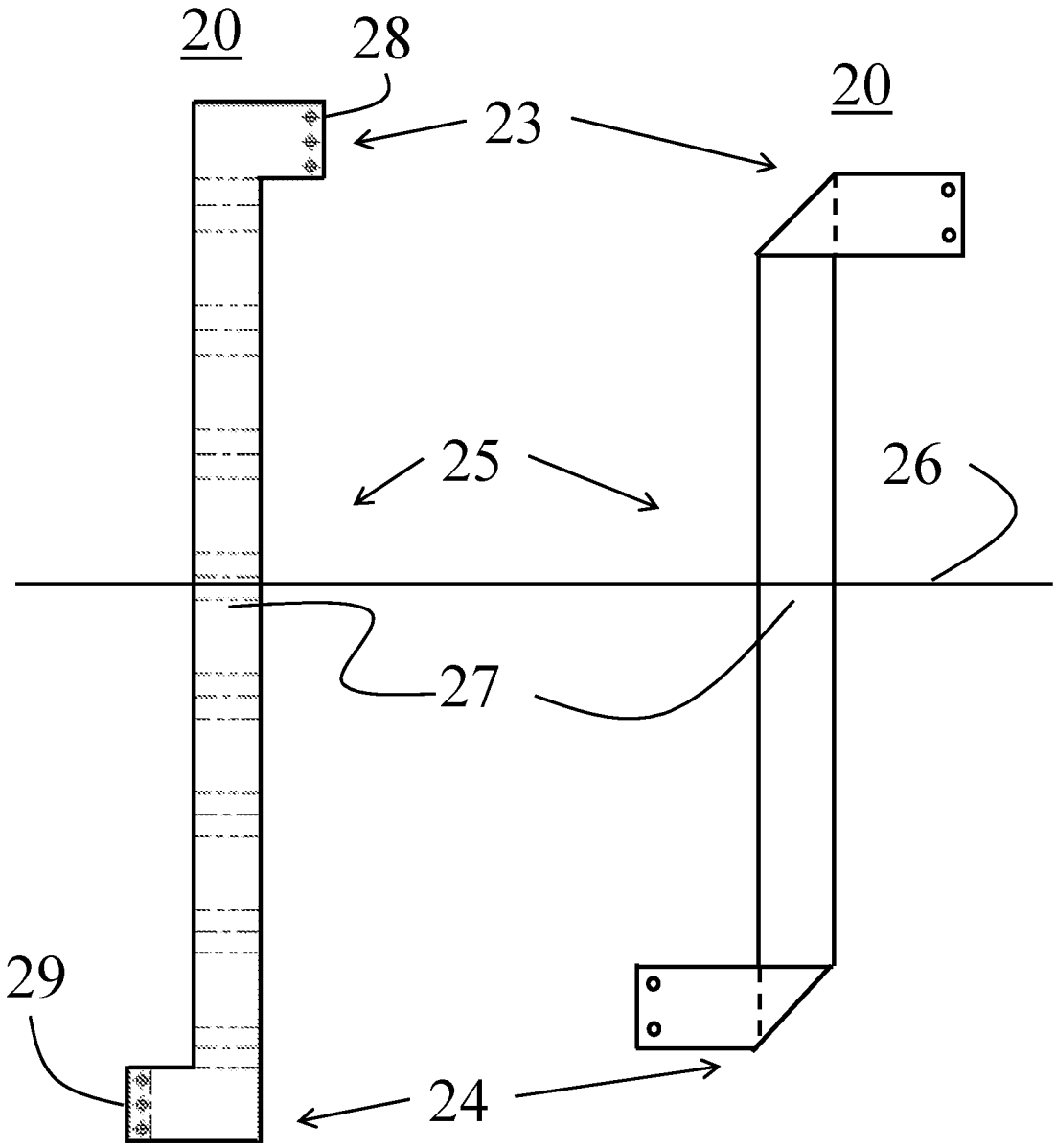
*Fig. 1A* *Fig. 1B*

METHOD OF FORMING A TRANSFORMER WINDING

CROSS-REFERENCE TO RELATED APPLICATIONS

This application claims priority to U.S. provisional application No. 62/368,250, filed Jul. 29, 2016, the contents of which are hereby incorporated by reference.

FIELD

The subject technology relates generally to power transformers and specifically to such systems and methods of efficiently cooling high frequency, high current power transformers.

BACKGROUND AND SUMMARY

Cooling presents a significant consideration when designing power transformers, especially for hi-frequency applications (e.g. 50 kHz to 500 kHz) which are much smaller in size relative to low frequency transformers. For example, a 15 kW, 100 kHz transformer is around 460 cc in volume, and might ideally have 1% power losses (i.e. 150 W), but more realistically, 2 to 3% losses are expected. A good cooling system is required to dissipate heat related to these losses.

The main losses of a transformer are determined by power losses of the winding, so it is very important to provide cooling of the winding. Losses are somewhat directly proportional to current, so higher currents (e.g a winding with a current of 300 A or more) present increased cooling challenges for the winding and winding terminations, including challenges relating to connecting the transformer with the power stage.

The design of the transformer described in U.S. Pat. No. 7,123,123 (the contents of which are incorporated herein by reference as if fully rewritten herein) provides good performance regarding efficiency, cooling, and integration of transformer into the power stage, but it can be used only when the high current winding has one turn.

The subject technology maintains many of the advantages of U.S. Pat. No. 7,123,123, and can additionally be used with two or more turns in the high current winding. In the various aspects of the subject technology described herein, a substantially flat and elongate conductor is used. More specifically, a high current transformer winding made from a flat conductor having opposing ends that are shaped (e.g. a lateral protrusion), such that when a middle portion of the conductor is wound around a transformer core, one or both opposing ends protrude to allow operative connection to a power source. In one aspect, "operatively connected to a power source" comprises being bolted to a bus bar. In one aspect, mounting holes (7) are disposed in conductor (20) (e.g. FIG. 3B) to allow bolting to a bus bar. In one aspect, opposing ends of a substantially flat & elongate conductor are folded so as to form lateral protrusions to allow operative connection to a power source. Such a flat conductor can be wound around a core multiple times. Conventional conductors are used for the low current, high voltage winding of the subject technology.

The flat, elongate high current winding of the subject technology (copper foil in one aspect) allows higher current capacity (e.g. twice as much), relative to a single winding configuration. Another advantage is achieved because the flat conductor allows more efficient heat transfer. The flat conductor bolted to a bus bar offers a relatively higher surface area at the junction, which mitigates heat buildup. The junction between the round and flat conductor of conventional systems creates an unwanted hot spot due to the decreased cross-sectional area and junction losses. The subject technology provides a flat terminal made out of a unitary piece of material (i.e. no junction between flat and round conductors) that can be bolted directly to the bus bar. The foregoing provides not only improved cooling, but also improved electrical conductance characteristics.

In one aspect, a 90 degree turn is imposed on each opposing end of the flat conductor in order to provide outwardly protruding end terminals that bolt directly to a bus bar. The 90 degree turn imposed on each end of flat conductor can be achieved various ways. The flat conductor can be folded on each end at a 45 degree angle, resulting in a 90 degree turn (e.g. FIG. 1B). Alternatively, the turn can be cut to shape as shown in FIG. 1A (e.g. using copper foil). The 90 degree turn can be oriented to either have both terminals project outwardly from the same or opposite sides of the core. The former configuration is needed for center tap embodiments as described elsewhere herein.

In some aspects (e.g. FIG. 6), two turns are disposed in each opposing end. Doing so results in the topology depicted in FIG. 5 wherein first and second lateral protrusions 28/29 are facing away from each other. The length of the conductor relative to outer perimeter of the core about which the conductor is wound, determines the number of turns, which consequently determines the final orientation of the end protrusions. In other words, the length of the conductor can be adjusted so that end protrusions 28/29 are facing the same way.

A conventional round conductor is wound around, and radially outside of, the high current winding to create the low current, high voltage winding. The low current conductor is wound around a bobbin in one aspect. Thus, the high and low current windings are concentrically and/or coaxially oriented with respect to each other. It is to be noted that the terms "concentric" and "coaxial" are specifically defined herein to include this relationship. The concentric high and low current windings surround a portion of a transformer core that is part of a core assembly that forms a magnetic flux circuit in one aspect.

BRIEF DESCRIPTION OF THE DRAWINGS

FIG. 1A depicts a plan view of conductor 20 in one aspect of the subject technology.

FIG. 1B depicts a plan view of conductor 20 in one aspect of the subject technology.

DETAILED DESCRIPTION

Figure 2A:
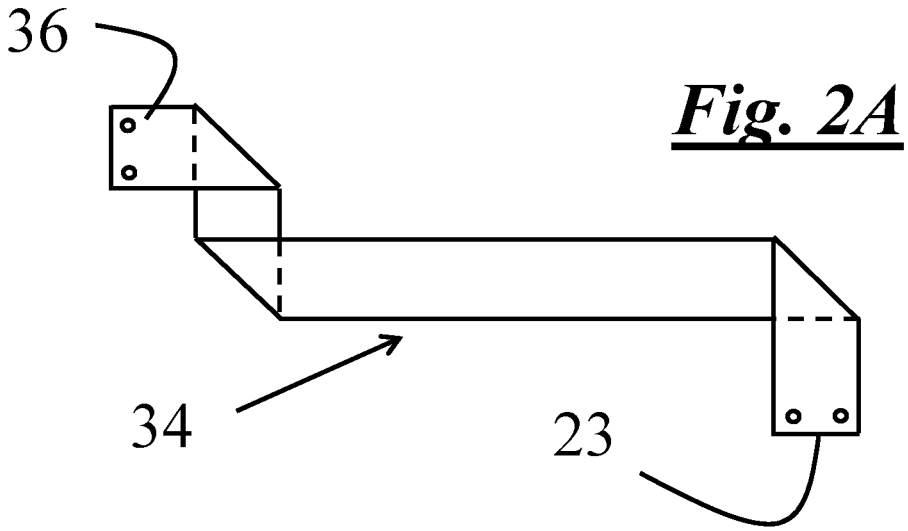
FIG. 2A depicts a plan view of first flat center tap conductor 34 of the subject technology.

In one aspect, a method of forming a transformer winding comprises the steps of: obtaining a conductor (20), the conductor being substantially flat and elongate, and further having first and second opposing ends (23, 24), and a middle portion (25); winding the middle portion (25) of the conductor (20) around a longitudinal axis (26); the first and second opposing ends (23, 24) each being adapted to be operatively connected to a power source.

In one aspect, conductor (20) is wound directly around a portion of a transformer core. In another aspect, conductor (20) is wound around a bobbin. The bobbin can form a part of a transformer assembly or alternatively be removable. It is to be understood that in the various configurations depicted herein as well as those apparent to those of skill in the art who have studied the subject technology disclosed herein, that insulation is used as needed to insure electrical isolation.

As used herein, winding the middle portion (25) of the conductor (20) around a longitudinal axis is defined as a longitudinal axis through a core, a portion of a core, a core leg, or alternatively a figurative longitudinal axis such that a cavity is formed for accommodating a transformer core or a portion of one. In other words, operative engagement with a transformer core is intended. It is to be therefore understood that "around" in this context is not limited to a circular shape, and additionally includes rectangular, ovoid, or other shapes as will be appreciated by those of skill in the art. As those of skill in the art will appreciate, at least a portion of the transformer core is encircled so as to influence a magnetic field in the portion of the transformer core. In one aspect, the middle portion (25) of the conductor (20) is wound around the longitudinal axis (or core) at least two times.

A transformer core, or a portion of a transformer core, is generally of rectangular cross section, elongate, and has a longitudinal axis (26). The conductor (20) is positioned laterally with respect to the longitudinal axis (26) (e.g. FIGS. 1A, 1B) and wound around the longitudinal axis 26 in a shape commensurate with the shape of the intended transformer core.

Figure 3A:
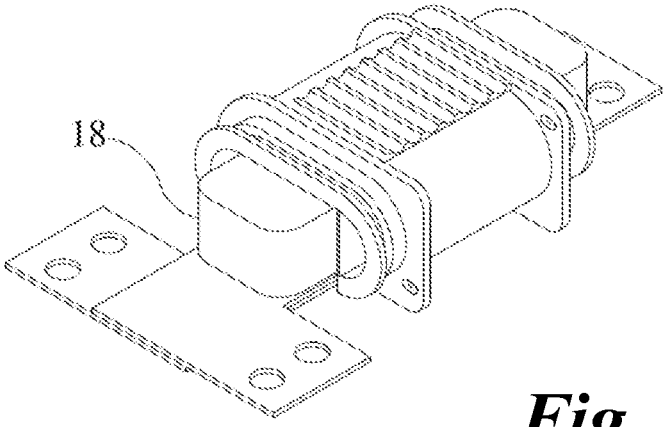
FIG. 3A depicts a perspective view of high current winding 20, i-core 18, and inner and outer bobbins 38, 33, respectively, in one aspect of the subject technology.
Figure 3B:
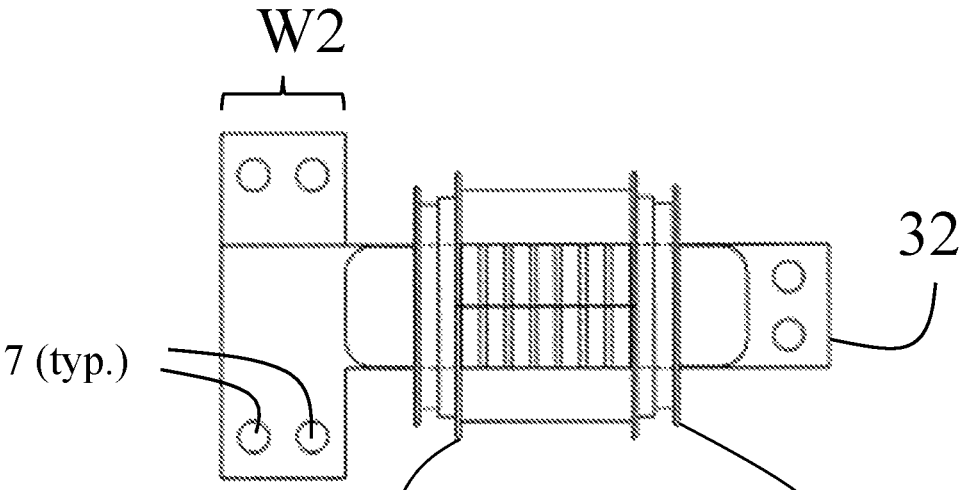
FIG. 3B depicts a plan view of FIG. 3A

The width of conductor (20) (Dimension (W2) in FIG. 3B) as well as the thickness are varied according to voltage, current, and heat considerations. In one aspect, the width (W2) of conductor (20) is in the range of 0.5 to 2 inches, and the thickness is in the range of 1/32 to 1/8 inches.

In one aspect (FIG. 1A), first and second lateral protrusions (28, 29) are disposed proximate first and second opposing ends (23, 24), respectively. In one aspect, first and second opposing ends (23, 24) are folded so as to allow protrusion along longitudinal axis 26 after conductor (20) has been wound (e.g. FIG. 5). The length of conductor (20), relative to the size the core around which the conductor is wound, is considered in assuring the protrusion is properly placed in the wound position such that the protrusion can be operatively connected to a power source.

The opposing ends of conductor 20 are adapted to facilitate electrical connection. A flat conductor (as opposed to a round conductor) has distinguishing characteristics in that it cannot be randomly bent in the same manner as a round conductor. Folding the conductor (e.g. FIG. 1B) creates a turn, or lateral protrusion. Such a lateral protrusion can also be created by cutting or stamping the conductor during fabrication (e.g. FIG. 1A).

In one aspect, either or both of the first and second opposing ends (23, 24) of the conductor are folded so as to form a turn. As shown in FIG. 1B folding first and second opposing ends 23, 24 results in a lateral protrusion (aka laterally oriented turn) somewhat similar to first and second lateral protrusions 28, 29 of FIG. 1A. As shown in FIGS. 1A & 1B, first and second opposing ends (23, 24) are folded so as to form oppositely oriented, substantially right angles. However, it should be noted that other angles are possible. In some aspects, the turn is accomplished by folding, but it should be noted that the conductor can be pre-formed, or cut with the turn disposed therein. Folding allows off-the-shelf flat stock to be used without the need for dies or cutting.

Figure 2B:
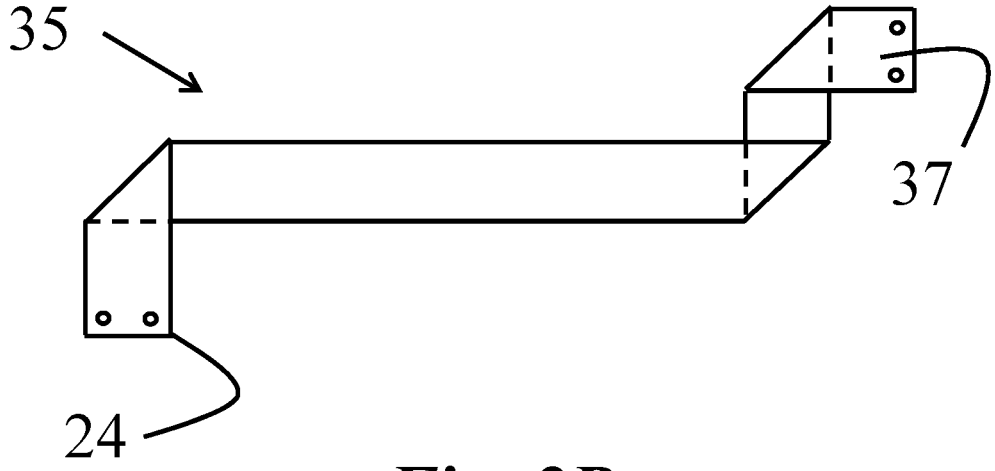
FIG. 2B depicts a plan view of second flat center tap conductor 35 of the subject technology.
Figure 5:
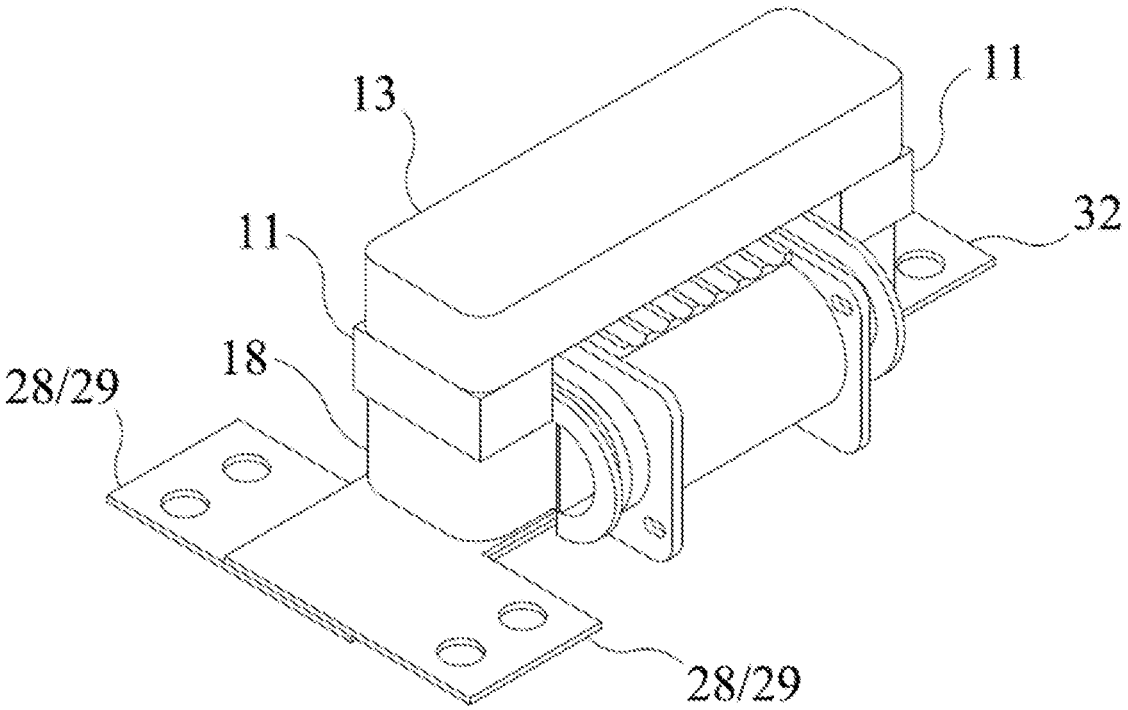
FIG. 5 depicts a perspective view of the transformer without low current winding 31 in one aspect of the subject technology.

Additional turns are imposed in some aspects. This can be accomplished by cutting or dies, or alternatively by additional folds. As shown in FIGS. 2A, 2B, two turns are disposed in opposing ends by folding the conductor two times. The configuration depicted in FIG. 5 is achieved by this method. As shown, 28/29 is intended to convey that either of 28 or 29 is shown above and the remaining member is below.

In one aspect, an apparatus of the subject technology comprises a conductor (20), the conductor being substantially flat and elongate, and having a middle portion (25) disposed intermediate first and second opposing ends (23, 24); the conductor (20) encircling a portion of a transformer core (18) to form a high current winding; and a low current winding (31) encircling both the portion of the transformer core and the high current winding. In one aspect, the portion of the transformer core comprises i-configuration core 18.

The low current winding (31) can be wound around a high current winding-core combination, or alternatively around a bobbin. The bobbin can be removed prior to assembly, or alternatively a bobbin suitable for use as part of the assembly is used.

As shown in FIG. 5, "i" configuration core 18 forms a portion of transformer core assembly 9, which comprises "i" configuration core 18, middle portions 11, and top portion 13. As shown in FIG. 5, middle portions 11 are sandwiched between "i" configuration core 18 and top portion 13 to create a magnetic flux circuit. Middle portions 11 and top portion 13 when assembled, form "c" configuration core 16. Alternatively, a "c" configuration core 16 can be formed from a unitary piece of material.

Figure 8:
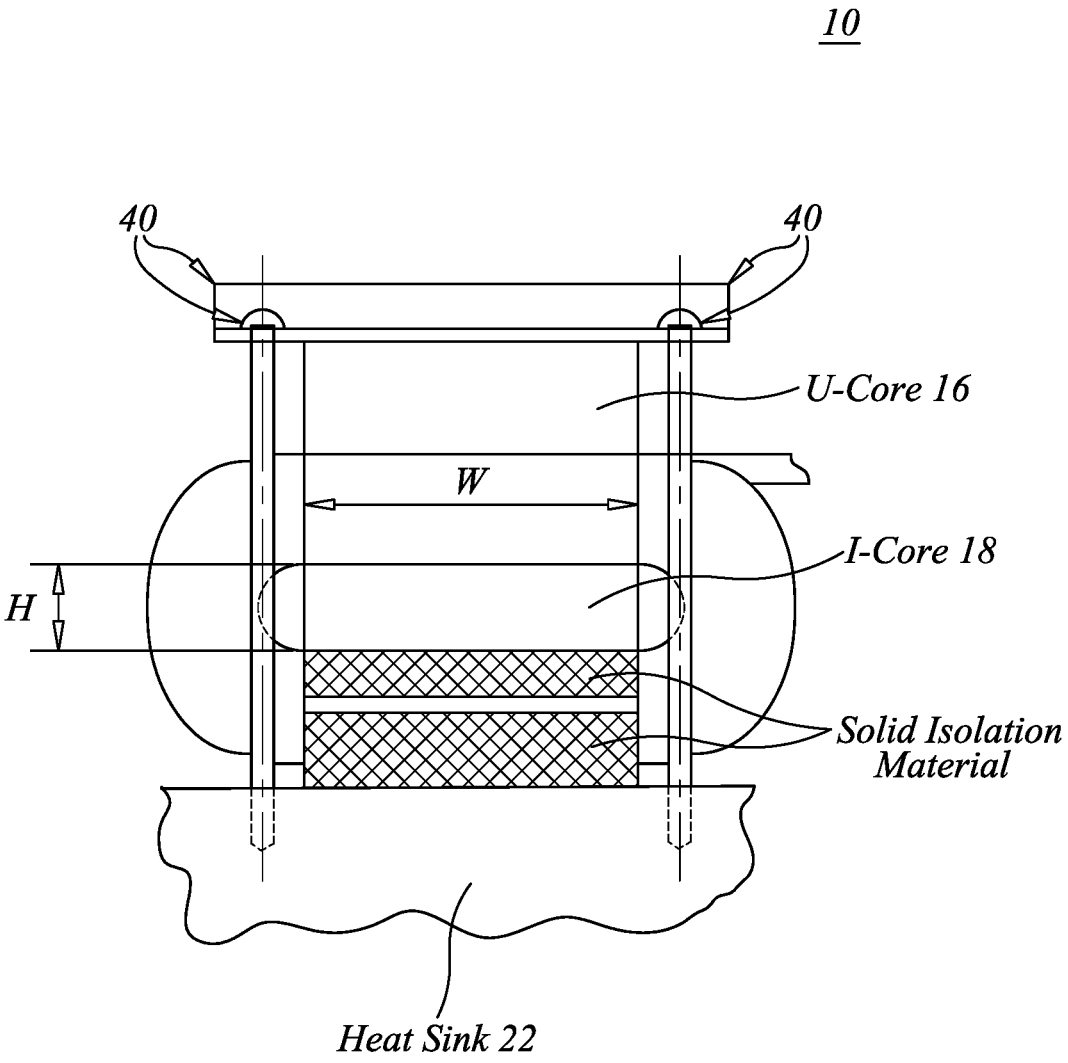
FIG. 8 depicts a side sectional view of the transformer taken along sectional line as indicated in FIG. 12

In one aspect, the transformer of the subject technology uses "C" configuration cores (aka "U" configuration core) in conjunction with "i" configuration core to form a core assembly having an opening, or window, through the middle thereof. The assembled "C" & "i" cores are held firmly together with a structural core support assembly 40 as depicted in FIG. 8. It is preferable that the width of high current winding ("W" in FIG. 8) be as wide as possible, preferably as close as possible to the width of the window in the transformer core assembly.

In one aspect, a first lateral protrusion (28) is disposed proximate the first opposing end (23) of the conductor (20);

a second lateral protrusion (29) is disposed proximate the second opposing end (24) of the conductor (20); wherein either or both of the first and second lateral protrusions (28, 29) can be operatively connected to a power source. In one aspect, conductor (20) encircles the portion of the transformer core (18) at least two times.

Figure 6:
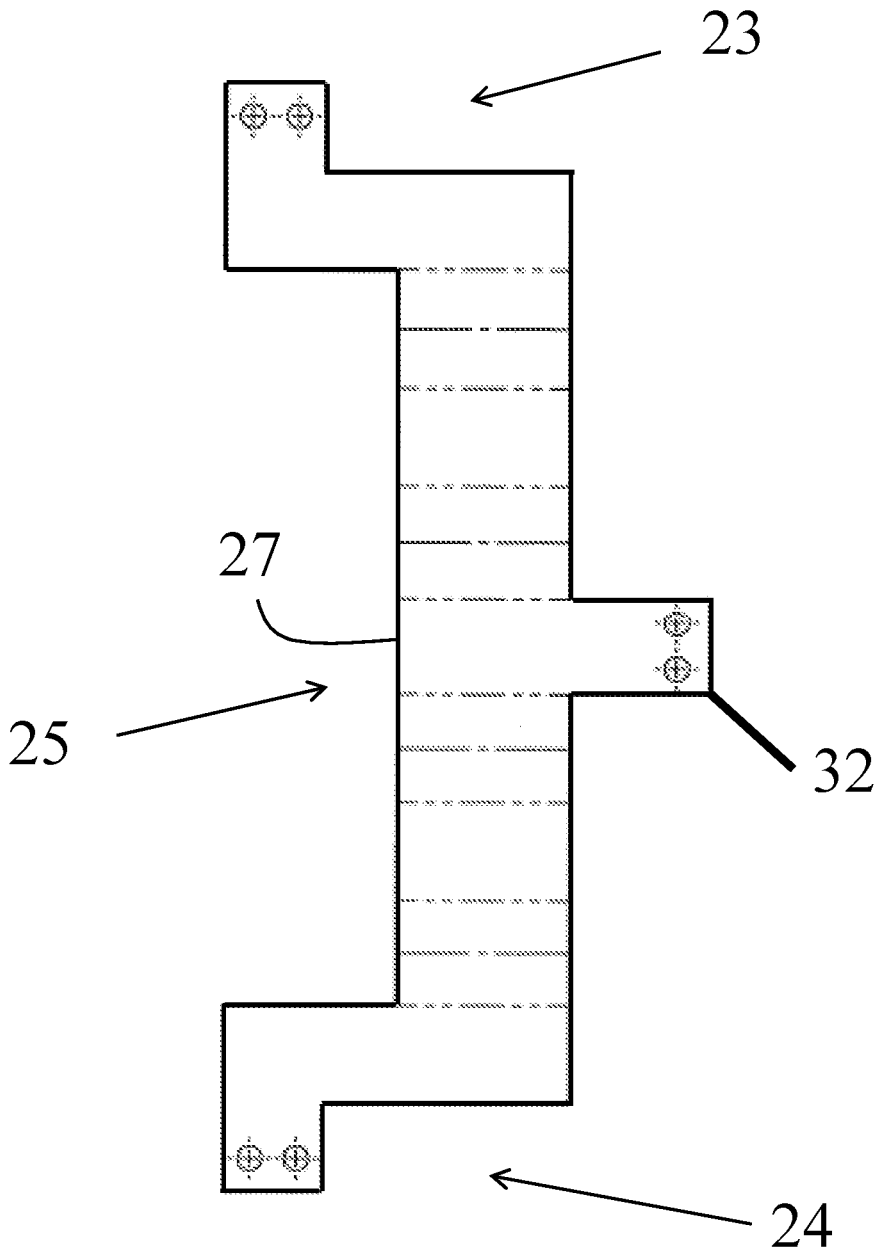
FIG. 6 depicts a plan view of conductor 20 in one aspect of the subject technology.

In one aspect (e.g. FIG. 6), center tap (32) is disposed proximate a center (27) of the middle portion (25) of the conductor (20). This topology results in the configuration shown in FIG. 3A-C, for example. As shown in FIG. 6, center tap (32) is formed in conductor (20). In another aspect, center tap (32) is realized with a two piece assembly. As shown in FIGS. 2A & 2B, first and second flat center tap conductors (34, 35) are connected at (36, 37) to form a two-piece flat conductor, such that combined (36, 37) forms the center tap (32).

Figure 3C:
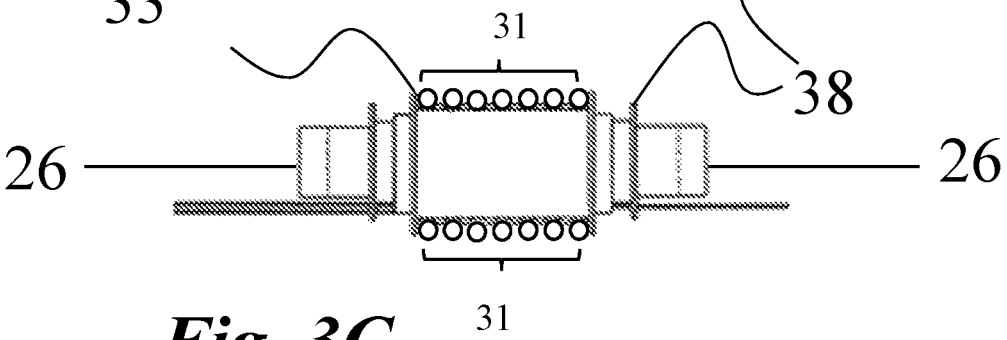
FIG. 3C depicts a side view of FIG. 3A with additional low current winding 31 in one aspect of the subject technology.
Figure 4:
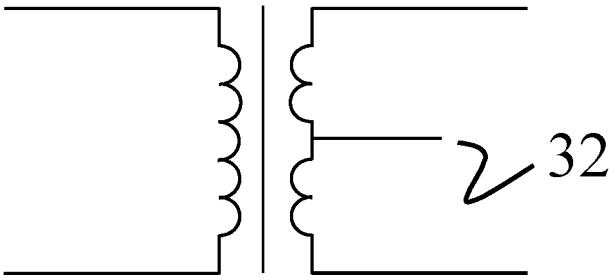
FIG. 4 depicts a schematic diagram of the transformer with center tap 32 in one aspect of the subject technology.
Figure 7:
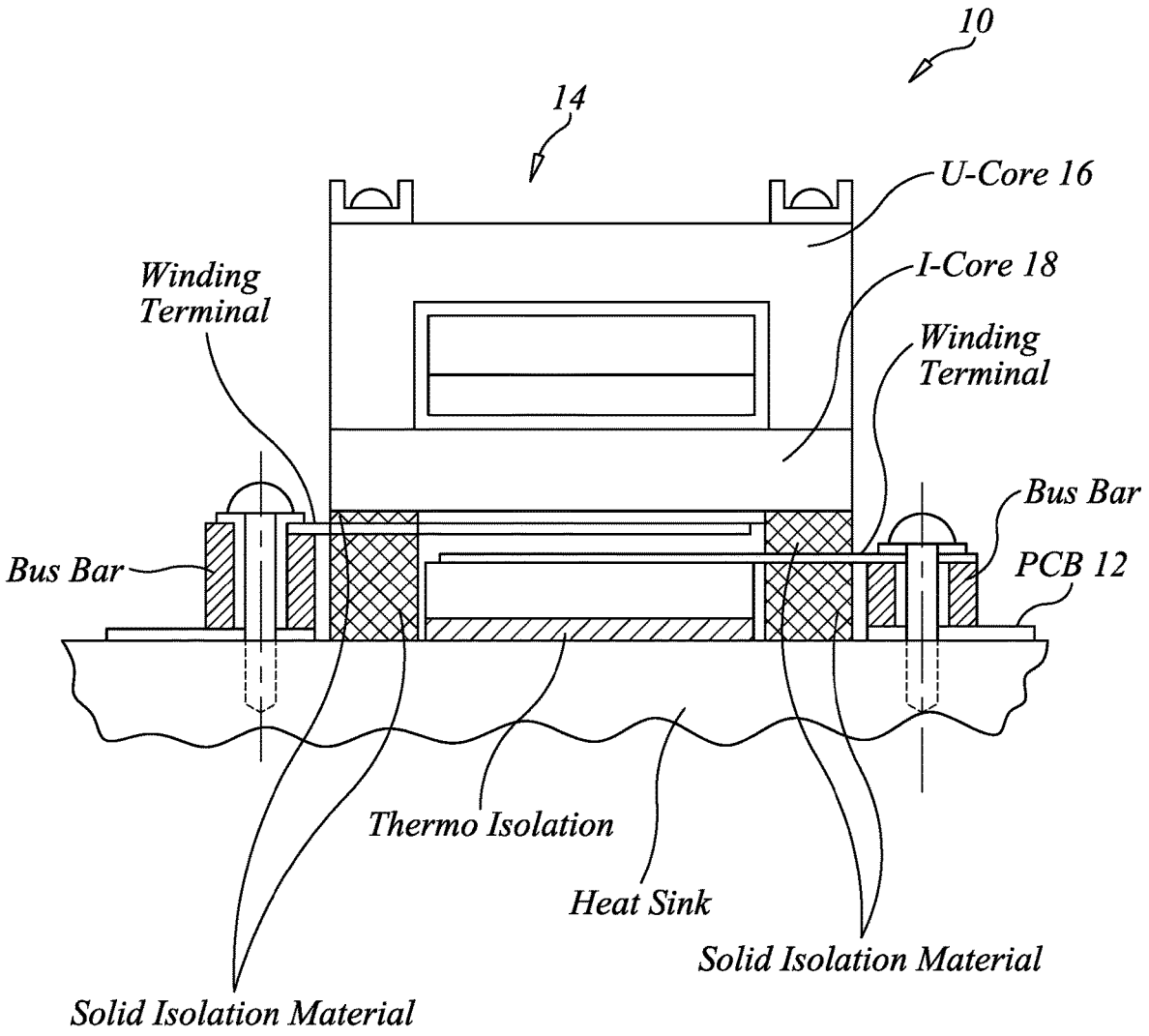
FIG. 7 depicts a side sectional view of the transformer taken along sectional line as indicated in FIG. 12
Figure 9:
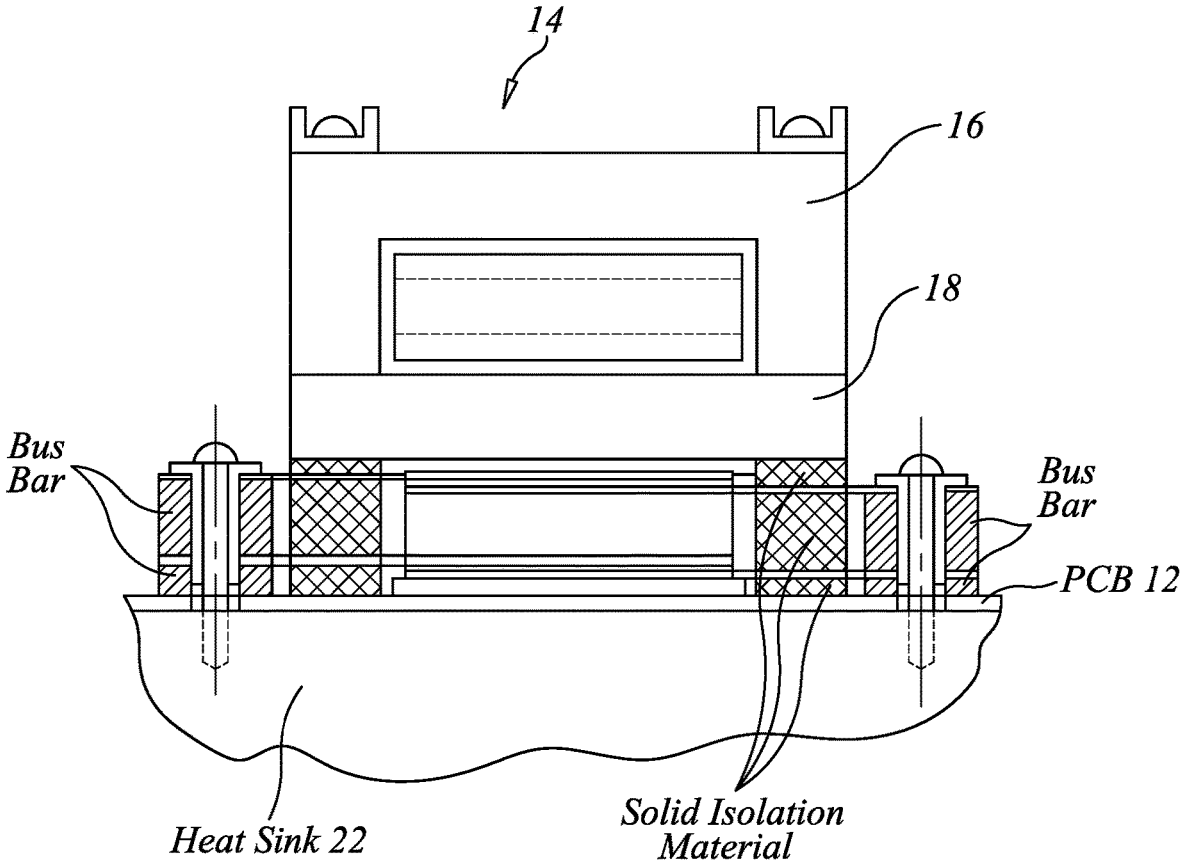
FIG. 9 depicts a side sectional view of the transformer in one aspect of the subject technology.
Figure 10:
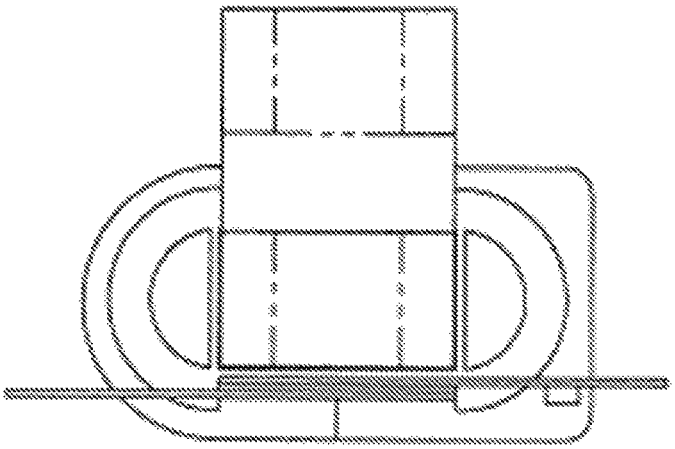
FIG. 10 depicts an end view of the transformer in one aspect of the subject technology.
Figure 11:
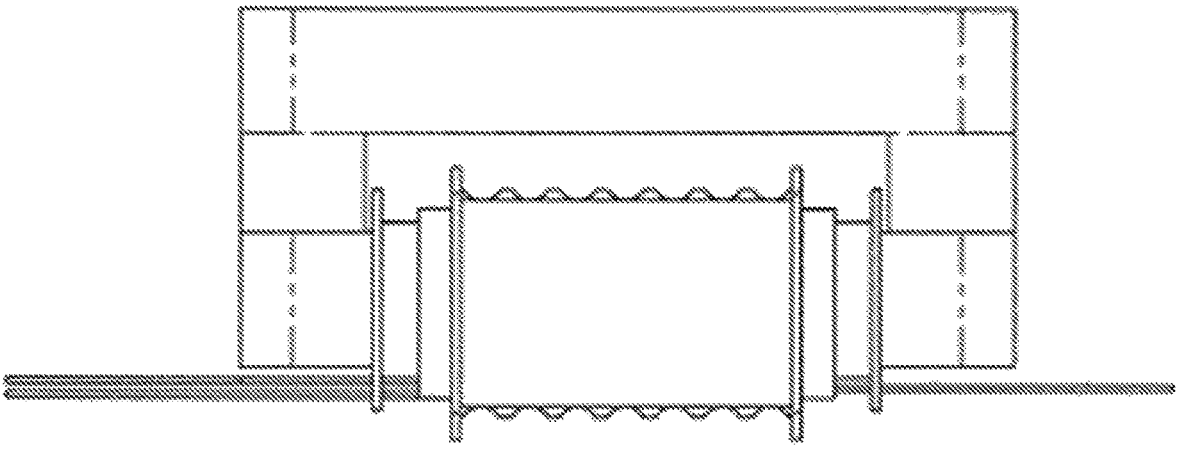
FIG. 11 depicts a side view of the transformer in one aspect of the subject technology.

In one aspect, a split-core configuration (FIGS. 3A-C) is presented wherein high current winding (20) is first wrapped around an inner bobbin (38) (with insulation material between each winding), within which is inserted "i" core (18); outer bobbin (33) is then placed over "i" core (18) and high current winding (20); low current winding (31) is then wound around, radially outside of, and concentric with outer bobbin (33) as depicted in FIG. 3C; the assembly is then placed in thermal communication with heat sink (22) (e.g. FIGS. 7-9) by physical or thermal contact wherein low current windings (31) are placed adjacent to or in physical contact with, printed circuit board (PCB) (12) which is then placed adjacent to or in physical contact with, heat sink (22). In one aspect, a material with high thermal conductivity (not shown) is placed between low current windings (31) and either the PCB (12) or directly with the heatsink (22). Conductor (20) is thereby operatively connected to heat sink. (22)

Placing the core and windings in physical proximity with the heat sink provides improved magnetic flux leakage characteristics. This arrangement is also advantageous because there is a reduction of interference from the transformer to PCB which is very close to the transformer. The transformer can be mounted directly to the heat sink (e.g. FIG. 8), or alternatively the PCB can be sandwiched between the heat sink and transformer (e.g. FIG. 7).

Another advantage is achieved because the high current winding is concentrically inside of the low current winding and thus is relatively closer to the heat sink. This results in a shorter thermal path. The flat high current windings described herein have a relatively large area for thermal communication with heat sink 22. In other words, an improved heat path is created through the windings and the heat sink by virtue of the flat conductor used.

Figure 12:
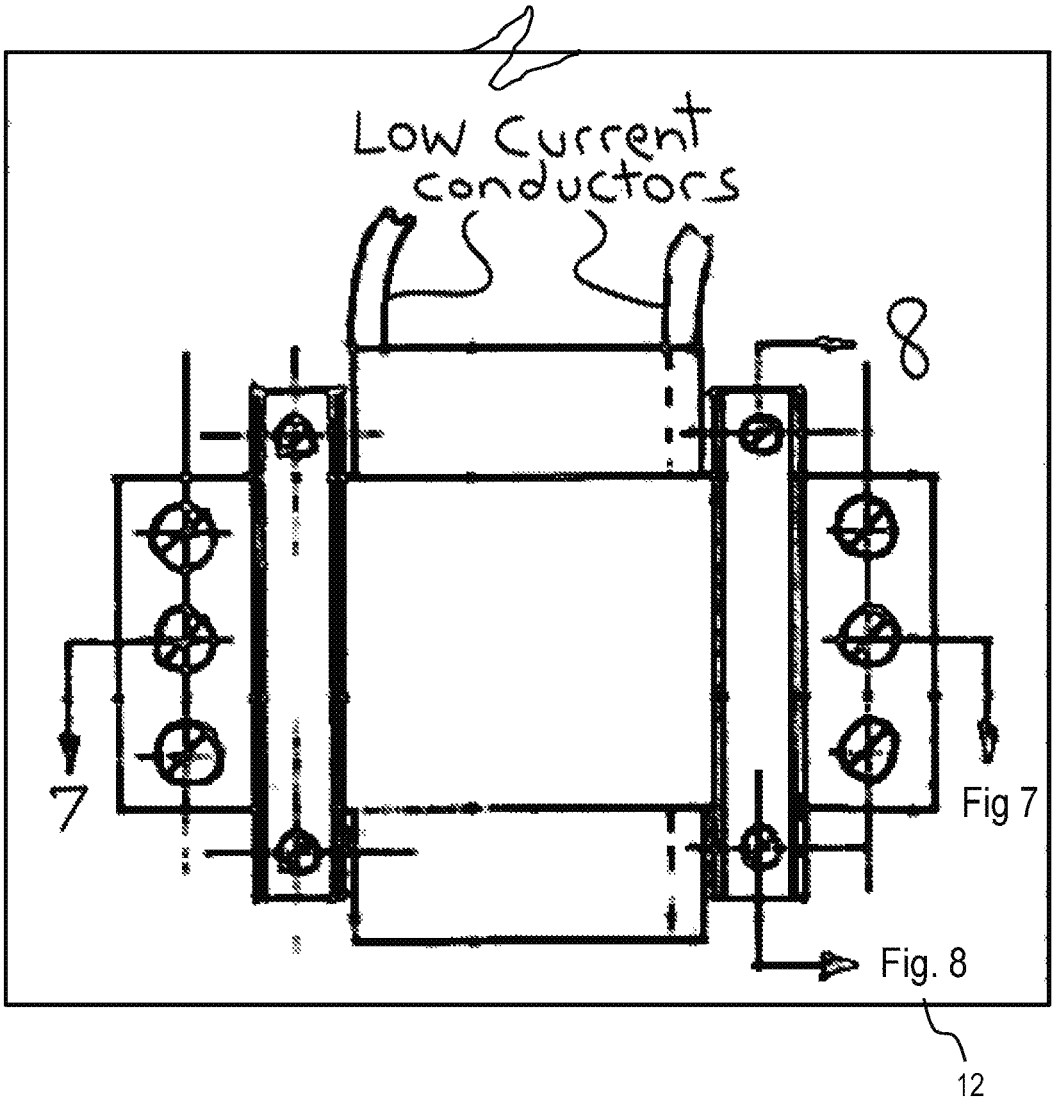
FIG. 12 depicts a top view of the transformer in one aspect of the subject technology.

FIG. 8 depicts a cross sectional view (along sectional line as indicated in FIG. 12) of "i" core 18. There is preferably a ratio of width "W" to height "H" of between 2 and 10. Ratios in this range have desirable transformer coupling, leakage inductance reduction, and better cooling.

While this invention has been shown and described with respect to detailed embodiments thereof, it will be understood by those skilled in the art that changes in form and detail thereof may be made without departing from the scope of the claims of the invention.

What is claimed is:

1. A method of forming a transformer winding comprising the steps of:

obtaining a conductor, the conductor being substantially flat and elongate, and further having first and second opposing ends, and a middle portion, wherein the conductor has at least one coplanar lateral protrusion disposed proximate either of the first or second opposing ends of the conductor;

and winding the middle portion of the conductor to form a high current winding;

wherein each of the first and second opposing ends is adapted to be operatively connected to a power source.

2. The method of claim 1 further comprising:

a first lateral protrusion disposed proximate the first opposing end of the conductor;

and a second lateral protrusion disposed proximate the second opposing end of the conductor.

3. The method of claim 1 further comprising:

folding either or both of the first and second opposing ends of the conductor so as to form a turn.

4. The method of claim 3 wherein the turn is a laterally oriented turn.

5. The method of claim 3 wherein the turn is an oppositely oriented, substantially right angle.

6. The method of claim 1 further comprising:

the middle portion of the conductor is wound around the longitudinal axis at least two times.

7. The method of claim 1 further comprising:

the middle portion of the conductor is wound around a transformer core.

8. The method of claim 1 further comprising:

the middle portion of the conductor is wound around a bobbin.

9. The method of claim 1 further comprising:

operatively connecting the conductor to a heat sink.

10. The method of claim 1 further comprising:

forming a low current winding radially outside of, and concentric with the high current winding;

operatively connecting the low and high current windings to a portion of a transformer core.

11. The method of claim 10 further comprising:

placing the low current winding in physical proximity to a heat sink.

12. The method of claim 10 further comprising:

placing the low current winding in physical contact with a heat sink.

13. The method of claim 10 further comprising:

placing the low current winding in thermal contact with a heat sink.

14. The method of claim 10 further comprising:

placing the low current winding in thermal contact with a printed circuit board.

* * * * *